US010839989B2

(12) United States Patent
Nakao

(10) Patent No.: US 10,839,989 B2
(45) Date of Patent: Nov. 17, 2020

(54) CHIP RESISTOR

(71) Applicant: Panasonic Intellectual Property Management Co., Ltd., Osaka (JP)

(72) Inventor: Mitsuaki Nakao, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 16/330,389

(22) PCT Filed: Sep. 21, 2017

(86) PCT No.: PCT/JP2017/034040

§ 371 (c)(1),
(2) Date: Mar. 5, 2019

(87) PCT Pub. No.: WO2018/061961

PCT Pub. Date: Apr. 5, 2018

(65) Prior Publication Data

US 2020/0090838 A1 Mar. 19, 2020

(30) Foreign Application Priority Data

Sep. 27, 2016 (JP) ..... 2016-187649

(51) Int. Cl.
*H01C 1/142* (2006.01)

(52) U.S. Cl.
CPC ..... *H01C 1/142* (2013.01)

(58) Field of Classification Search
CPC ..... H01C 1/142
(Continued)

(56) References Cited

U.S. PATENT DOCUMENTS 4,845,513 A * 7/1989 Sugata ..... B41J 2/33515 347/204
5,111,179 A * 5/1992 Flassayer ..... H01C 1/142 338/272

(Continued)

FOREIGN PATENT DOCUMENTS

| | | |
|---|---|---|
| JP | 10-144501 | 5/1998 |
| JP | 2004-031849 | 1/2004 |
| JP | 2011-222757 | 11/2011 |

OTHER PUBLICATIONS

International Search Report of PCT application No. PCT/JP2017/034040 dated Nov. 14, 2017.

*Primary Examiner* — Kyung S Lee
(74) *Attorney, Agent, or Firm* — McDermott Will & Emery LLP

(57) ABSTRACT

An object of the present disclosure is to provide a chip resistor that reduces a possibility of occurrence of a mounting failure. The chip resistor of the present disclosure includes: insulating substrate; a pair of first upper-face electrodes that is provided at both end portions of an upper face of insulating substrate; and resistor that is provided on the upper face of insulating substrate and is formed between the pair of first upper-face electrodes. The chip resistor also includes: a pair of second upper-face electrodes that is formed on upper faces of the pair of first upper-face electrodes and is connected to resistor; and protective film that is provided to cover exposed resistor and part of the pair of second upper-face electrodes.

2 Claims, 3 Drawing Sheets

(58) Field of Classification Search
USPC ..... 338/309
See application file for complete search history.

(56) References Cited

U.S. PATENT DOCUMENTS

| | | | | |
|---|---|---|---|---|
| 5,907,274 | A * | 5/1999 | Kimura | H01C 1/142 338/308 |
| 7,352,273 | B2 * | 4/2008 | Tanimura | H01C 7/003 338/307 |
| 7,782,173 | B2 * | 8/2010 | Urano | H01C 1/012 338/307 |
| 9,728,306 | B2 * | 8/2017 | Lu | H01C 17/02 |
| 2014/0367153 | A1 * | 12/2014 | Yoneda | H01C 1/014 174/260 |

* cited by examiner

CHIP RESISTOR

This application is a U.S. national stage application of the PCT International Application No. PCT/JP2017/034040 filed on Sep. 21, 2017, which claims the benefit of foreign priority of Japanese patent application No. 2016-187649 filed on Sep. 27, 2016, the contents all of which are incorporated herein by reference.

FIELD OF THE INVENTION

The present disclosure relates to a small-size chip resistor that is formed of a thick film resistor with a low resistance value to be used in various electronic devices.

DESCRIPTION OF THE RELATED ART

As illustrated in FIG. 5, this conventional kind of chip resistor includes: insulating substrate 1; a pair of first upper-face electrodes 2 that is provided on both end portions of an upper face of insulating substrate 1; resistor 3 that is provided on the upper face of insulating substrate 1 and is formed between the pair of first upper-face electrodes 2; and a pair of second upper-face electrodes 4 that is formed on upper faces of the pair of first upper-face electrodes 2 and is connected to resistor 3. Further, the chip resistor includes: protective film 5 that is provided to cover exposed resistor 3 and part of the pair of second upper-face electrodes 4; a pair of end-face electrodes 6 that is provided on both end faces of insulating substrate 1 in such a manner as to be electrically connected to the pair of first upper-face electrodes 2; and plating layer 7 that is formed on surfaces of part of the pair of second upper-face electrodes 4 and the pair of end-face electrodes 6.

As a related art reference on the invention of the present application, PTL 1 is known, for example.

CITATION LIST

Patent Literature

PTL 1: Unexamined Japanese Patent Publication No. 2011-222757

SUMMARY OF THE INVENTION

In the conventional chip resistor described above, end portions 3*a* on both sides of resistor 3 are formed at end portions of upper faces of the pair of first upper-face electrodes 2, and thus end portions 3*a* on both sides of resistor 3 bulge upward. In addition, end portions 3*a* bulging upward on the both sides of resistor 3 overlap end portions 4*a* opposed to each other of the pair of second upper-face electrodes 4, and thus end portions 4*a* of the pair of second upper-face electrodes 4 protrude upward at the overlapping place. This generates an inclination or slope on the upper faces of the pair of second upper-face electrodes 4. As a result, both end portions of protective film 5 also protrude upward. Therefore, there is generated a difference in height on the upper face of the chip resistor. In the case of implementing the upper face as a mounting surface, there is a possibility of occurrence of a mounting failure such as a tombstone phenomenon.

The present disclosure is to solve the conventional issue described above. An object of the present disclosure is to provide a chip resistor that reduces a possibility of occurrence of a mounting failure.

To attain the foregoing object, in the invention of the present disclosure, a length of a portion of a resistor formed on a pair of first upper-face electrodes is made longer than a length of a portion of the resistor formed between the pair of first upper-face electrodes.

In the chip resistor of the present disclosure, bulging portions of the resistor at the both ends can be separated from positions of both ends of the pair of second upper-face electrodes, which makes it possible to suppress upward protrusion of the end portions opposed to each other of the pair of second upper-face electrodes. This prevents generation of an inclination or slope on the upper faces of the end portions of the pair of second upper-face electrodes. This produces an excellent advantageous effect that, even in the case of implementing the upper face as a mounting surface, it is possible to reduce a possibility of occurrence of a mounting failure such as a tombstone phenomenon caused by a difference in height on the upper face of the chip resistor.

DESCRIPTION OF EMBODIMENT DETAILED DESCRIPTION OF THE PREFERRED EMBODIMENTS

A chip resistor in an exemplary embodiment of the present disclosure will be described below with reference to the drawings.

Figure 1:
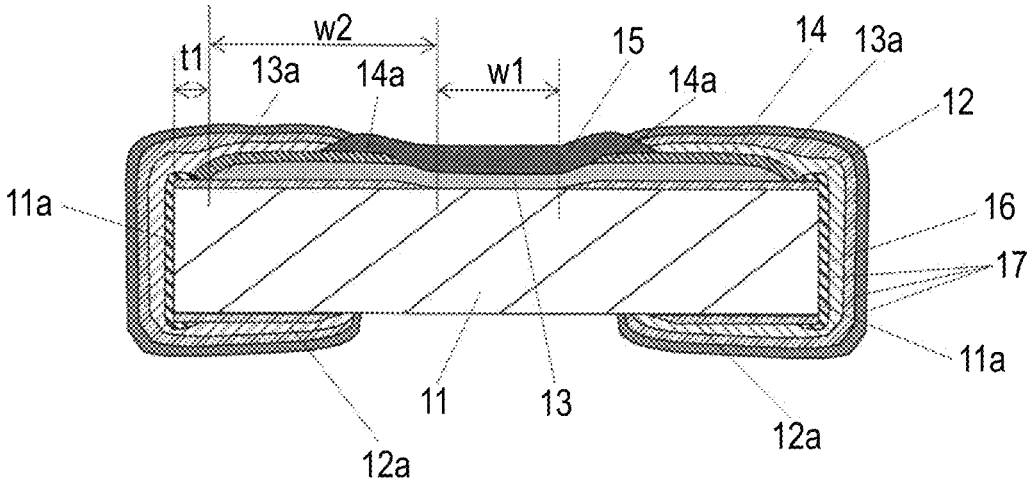
FIG. 1 is a cross-sectional view of a chip resistor in an exemplary embodiment of the present disclosure.

FIG. 1 is a cross-sectional view of a chip resistor in an exemplary embodiment of the present invention.

The chip resistor in one exemplary embodiment of the present disclosure includes insulating substrate 11, a pair of first upper-face electrodes 12, resistor 13, a pair of second upper-face electrodes 14, protective film 15, a pair of end-face electrodes 16, and plating layer 17. The pair of first upper-face electrodes 12 is provided on both end portions of upper face of insulating substrate 11. Resistor 13 is provided on an upper face of insulating substrate 11 and is formed between the pair of first upper-face electrodes 12. The pair of second upper-face electrodes 14 is formed on upper faces of the pair of first upper-face electrodes 12 and is connected to resistor 13. Protective film 15 is provided to cover exposed resistor 13 and part of the pair of second upper-face electrodes 14. The pair of end-face electrodes 16 is provided on both end faces of insulating substrate 11 in such a manner as to be electrically connected to the pair of first upper-face electrodes 12. Plating layer 17 is formed on part of the pair of second upper-face electrodes 14 and surfaces of the pair of end-face electrodes 16.

Length w2 of a portion of resistor 13 formed on the pair of first upper-face electrodes 12 is made longer than length w1 of a portion of resistor 13 formed between the pair of first upper-face electrodes 12. Distance t1 between either of front ends of end portions 13*a* on both sides of resistor 13 and either of end faces 11*a* of insulating substrate 11 is set to 100 μm or less.

In the foregoing configuration, insulating substrate 11 is formed of alumina containing 96% $Al_2O_3$ and is rectangular in shape. A length, width, and thickness of insulating substrate 11 are as described in [Table 1] below.

TABLE 1

| | Length (μm) | Width (μm) | Thickness (μm) |
|---|---|---|---|
| Insulating substrate 11 | 1600 | 800 | 500 |

The pair of first upper-face electrodes 12 is provided on both end portions of upper face of insulating substrate 11 and is formed by printing and sintering a thick film material made of silver, silver palladium, or copper. Back face electrodes 12*a* may be formed at both end portions of insulating substrate 11. FIG. 1 illustrates a chip resistor in which back face electrodes 12*a* are formed at the both end portions of a back face of insulating substrate 11. The cross-sectional view of insulating substrate 11 of FIG. 1 is a cross-sectional view taken along a plane including a length direction and a thickness direction of insulating substrate 11. A length of insulating substrate 11 can be 1000 μm to 2000 μm inclusive, a width of insulating substrate 11 can be 500 μm to 1000 μm inclusive, and a thickness of insulating substrate 11 can be 300 μm to 500 μm inclusive.

Further, resistor 13 is formed by printing a thick film material made of silver palladium, ruthenium oxide, or copper nickel on an upper face of insulating substrate 11 between the pair of first upper-face electrodes 12 and then sintering the thick film material. End portions 13*a* on the both sides of resistor 13 are positioned on the upper faces of the pair of first upper-face electrodes 12. Resistor 13 is not bar-shaped, and end portions 13*a* on the both sides are positioned inside insulating substrate 11.

A protective glass layer of pre-coat glass may be provided to cover resistor 13. Further, a trimming groove for resistance value adjustment (hereinafter, not illustrated) may be provided in resistor 13.

The pair of second upper-face electrodes 14 is formed by printing and sintering a thick film material made of silver, silver palladium, or copper. The pair of second upper-face electrodes 14 is formed on part of first upper-face electrodes 12 not covered by resistor 13 and the upper face of resistor 13 and is connected to resistor 13. End portions 14*a* opposed to each other (facing inward) of the pair of second upper-face electrodes 14 are covered by protective film 15.

Protective film 15 is formed of a thick film material made of glass or epoxy resin to cover part of the pair of second upper-face electrodes 14 and resistor 13.

The pair of end-face electrodes 16 is provided at the both end portions of insulating substrate 11 and is formed by printing a material made of Ag and a resin to be electrically connected to the pair of first upper-face electrodes 12 exposed from the pair of second upper-face electrodes 14.

Further, plating layer 17 including a Cu plating layer, an Ni plating layer, and an Sn plating layer is formed on surfaces of the pair of end-face electrodes 16. In this case, plating layer 17 is connected to the pair of second upper-face electrodes 14 in such a manner as to cover part of the pair of second upper-face electrodes 14, and is in contact with protective film 15.

Example

An example of the present exemplary embodiment will be described below.

In the present example, materials and thicknesses of first upper-face electrodes 12, resistor 13, second upper-face electrodes 14, protective film 15, end-face electrodes 16, and plating layer 17 are as described in [Table 2]. The thickness of plating layer 17 is total thicknesses of the Cu layer, the Ni layer, and the Sn layer. Insulating substrate 11 is formed of alumina containing 96% $Al_2O_3$ and is rectangular in shape. Length, width, and thickness of insulating substrate 11 are as described in [Table 1] above.

TABLE 2

| | Material | Thickness (μm) |
|---|---|---|
| First upper-face electrode 12 | Ag | 10 to 20 |
| Resistor 13 | AgPd | 20 to 30 |
| Second upper-face electrode 14 | Ag | 5 to 15 |
| Protective film 15 | Epoxy resin | 25 to 50 |
| End-face electrode 16 | Ag | 5 to 20 |
| Plating layer 17 | Cu | 10 to 45 |
| | Ni | 3 to 15 |
| | Sn | 3 to 15 |

In the present example, values of parameters t1, w1, and w2 described above are as in [Table 3].

TABLE 3

| | Length (μm) |
|---|---|
| t1 | 100 |
| w1 | 200 to 400 |
| w2 | 500 to 1000 |

End portions 13*a* on the both sides of resistor 13 are positioned near end faces 11*a* of insulating substrate 11, and length w2 of the portion of resistor 13 formed on the pair of first upper-face electrodes 12 is made longer than length w1 of the portion of resistor 13 formed between the pair of first upper-face electrodes 12. Further, distance t1 between either of the front ends of end portions 13*a* on both sides of resistor 13 and either of end faces 11*a* of insulating substrate 11 is set to 100 μm or less. Dimension of w1 regulates a resistance value. Dimension of w2 is preferably 1.5 times to 2.5 times inclusive longer than the dimension of w1.

As described above, in the present example, length w2 of the portion of resistor 13 formed on the pair of first upper-face electrodes 12 is made longer than length w1 of the portion of resistor 13 formed between the pair of first upper-face electrodes 12. In addition, the positions of end portions 13*a* on the both sides of resistor 13 and the positions of end portions 14*a* opposed to each other of the pair of second upper-face electrodes 14 are separated from each other. This suppresses upward protrusion of end portions 14*a* of the pair of second upper-face electrodes 14. This prevents generation of an inclination or slope on the upper faces of the pair of second upper-face electrodes 14. This produces an advantageous effect that, even in the case of implementing the upper face as a mounting surface, it is possible to reduce a possibility of occurrence of a mounting failure such as a tombstone phenomenon due to a difference in height caused by an inclination or slope.

Specifically, length w2 of the portion of resistor 13 formed on the pair of first upper-face electrodes 12 is made longer than length w1 of the portion of resistor 13 formed between the pair of first upper-face electrodes 12. Accordingly, end portions 13*a* on the both sides of resistor 13 are close to end faces 11*a* of insulating substrate 11, and end portions 13*a* on the both sides of resistor 13 are separated from the end portions of upper faces of the pair of first upper-face electrodes 12. Accordingly, end portions 13*a* on the both sides of resistor 13 do not bulge upward, and thus the upper faces of the pair of second upper-face electrodes 14 are flat with a smaller difference in height caused by an inclination or slope. As a result, the inclination or slope on the upper face of plating layer 17 on the upper faces of the pair of second upper-face electrodes 14 becomes small. In addition, the both end portions of protective film 15 do not protrude upward, and thus the upper face of the chip resistor becomes horizontal (flat), thereby suppressing the occurrence of a mounting failure such as tombstone phenomenon due to a difference in level of the upper face of the chip resistor.

On the other hand, when end portions 13*a* on the both sides of resistor 13 are separated from end faces 11*a* of insulating substrate 11 and end portions 13*a* on the both sides of resistor 13 are close to the end portions of the upper faces of the pair of first upper-face electrodes 12 as in the conventional case, end portions 13*a* on the both sides of resistor 13 bulge upward. Accordingly, the surfaces of the pair of second upper-face electrodes 14 are more inclined with increasing proximity to protective film 15 along the bulging shape. As a result, an inclination or slope on the upper face of plating layer 17 on the upper faces of the pair of second upper-face electrodes 14 also becomes large. In addition, the both end portions of protective film 15 protrude upward, and thus the upper face of the chip resistor does not become flat and there is a possibility of occurrence of a mounting failure such as a tombstone phenomenon due to a difference in height on the upper face of the chip resistor caused by the inclination or slope.

In the resistor of the present disclosure, distance t1 between either of the front ends of end portions 13*a* on both sides of resistor 13 and either of end faces 11*a* of insulating substrate 11 is preferably close to 100 μm or less.

Figure 2:
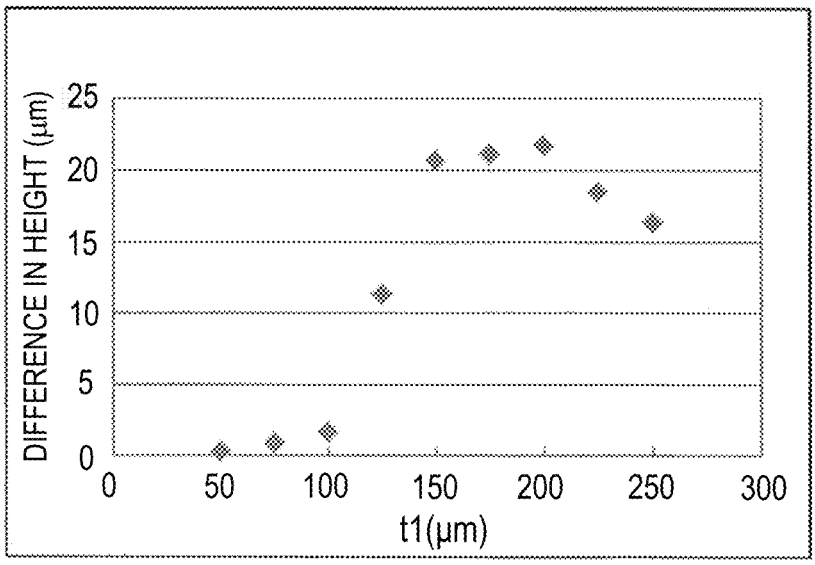
FIG. 2 is a diagram illustrating a relationship in the chip resistor between distance t1 from either of front ends of both end portions of a resistor to either of end faces of an insulating substrate and a difference in height on a pair of second upper-face electrodes caused by an inclination or slope.

FIG. 2 is a diagram illustrating a relationship in the chip resistor of 1608 size described in [Table 1] between distance t1 from either of the front ends of end portions 13*a* on the both sides of resistor 13 to either of the end faces 11*a* of insulating substrate 11 and a dimension of a difference in height on the upper faces of the pair of second upper-face electrodes 14 caused by an inclination or slope.

In this case, the dimension in height between either of the upper faces of the pair of second upper-face electrodes 14 at 100 μm from end faces 11*a* of insulating substrate 11 (point A in FIGS. 3 and 4) and either of the upper faces of the pair of second upper-face electrodes 14 at a portion of contact portion with protective film 15 (point B in FIGS. 3 and 4) was measured. A length of protective film 15 was unchanged.

The followings can be seen from FIG. 2. Specifically, end portions 13*a* on the both sides of resistor 13 are brought closer to end faces 11*a* of insulating substrate 11 such that distance t1 between either of the front ends of end portions 13*a* on the both sides of resistor 13 and either of end faces 11*a* of insulating substrate 11 becomes 100 μm or less (6% or less of length of insulating substrate 11). Then, the positions of end portions 13*a* on the both sides of resistor 13 and end portions 14*a* opposed to each other of the pair of second upper-face electrodes 14 are separated from each other. It can be seen that this reduces the difference in height.

Figure 3:
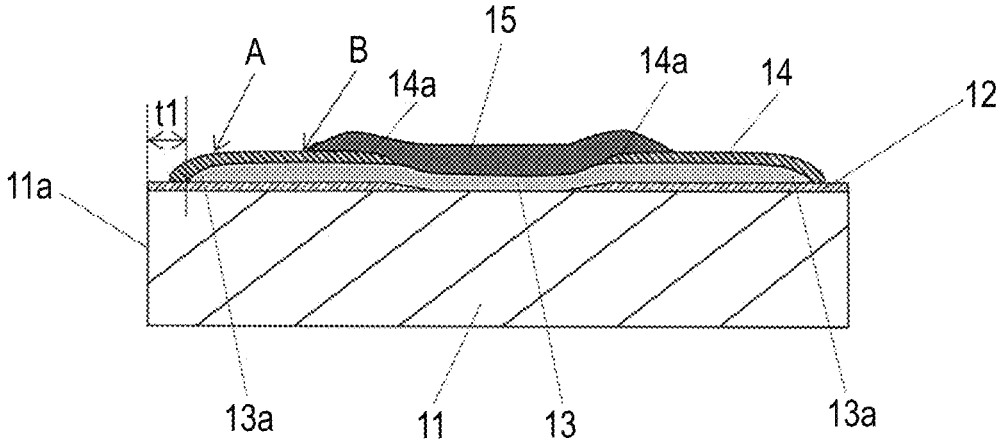
FIG. 3 is a cross-sectional view of main components of the chip resistor.

When distance t1 is 100 μm or less as in the resistor of the present disclosure, end portions 13*a* on the both sides of resistor 13 are separated from the end portions of the upper faces of the pair of first upper-face electrodes 12, and end portions 13*a* on the both sides of resistor 13 do not bulge upward as illustrated in FIG. 3. Accordingly, the upper faces of the pair of second upper-face electrodes 14 become horizontal with a small inclination and a small difference in height. Distance t1 is preferably set to 50 μm or less.

Figure 4:
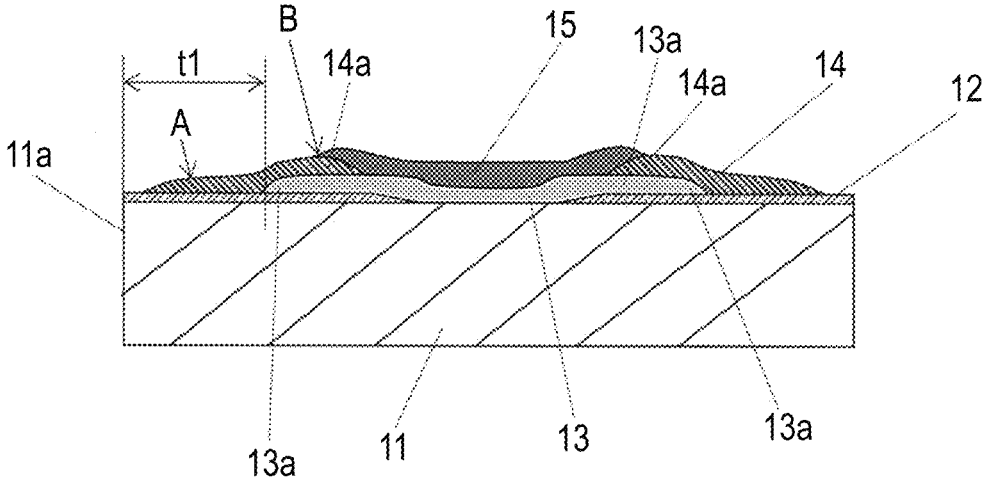
FIG. 4 is a cross-sectional view of main components of a chip resistor different from the foregoing chip resistor.
Figure 5:
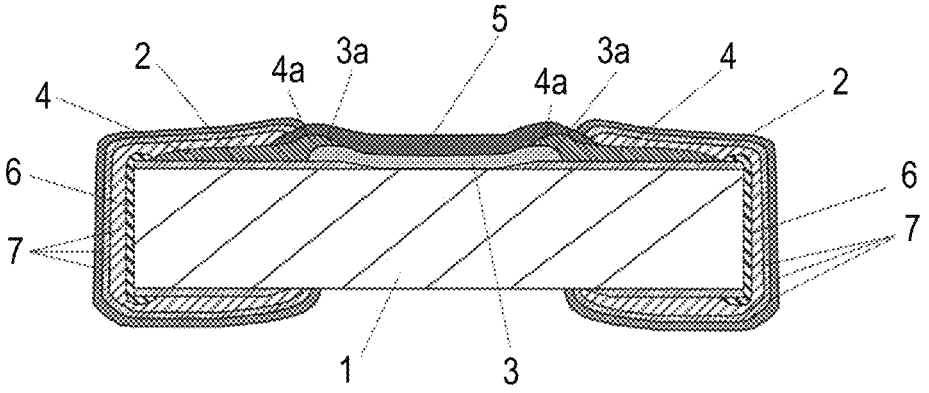
FIG. 5 is a cross-sectional view of a conventional chip resistor.

In contrast, when distance t1 is set to larger than 100 μm as illustrated in FIG. 4, end portions 13*a* on the both sides of resistor 13 become closer to the end portions of the upper faces of the pair of first upper-face electrodes 12, and thus end portions 13*a* on the both sides of resistor 13 bulge upward. The upper faces of the pair of second upper-face electrodes 14 are more inclined and have a larger difference in height with increasing proximity to protective film 15 along the bulging shape. FIGS. 3 and 4 do not illustrate the pair of end-face electrodes 16 and plating layer 17 for the sake of simple description. FIGS. 3 and 4 describe the distance from either of end faces 11*a* of insulating substrate 11 to protective film 15 as 200 μm. When distance t1 exceeds 200 μm, the front ends of end portions 13*a* on the both sides of resistor 13 become more inward than protective film 15, and thus protective film 15 is formed between the pair of second upper-face electrodes 14 and end portions 13*a* on the both sides of resistor 13. Accordingly, the inclination is absorbed to prevent an increase of difference in height.

In this case, a lower limit value of distance t1 between either of the front ends of end portions 13*a* on the both sides of resistor 13 and either of end faces 11*a* of insulating substrate 11 is decided with consideration given to printing accuracy and division accuracy, and is set to 5 μm, for example.

The chip resistor according to the present disclosure provides an advantageous effect of reducing a possibility of occurrence of a mounting failure, and in particular, is useful in a small-size chip resistor that is used in various kinds of electronic devices and is formed of a thick film resistor with low resistance value.

The invention claimed is:

1. A chip resistor comprising:

an insulating substrate;

a pair of first upper-face electrodes that is provided at both end portions of an upper face of the insulating substrate;

a resistor that is provided on the upper face of the insulating substrate and is formed between the pair of first upper-face electrodes;

a pair of second upper-face electrodes that is provided on upper faces of the pair of first upper-face electrodes and is provided at both end portions of the resistor; and a protective film that is provided to cover a portion of the resistor existing between the pair of second upper-face electrodes and part of the pair of second upper-face electrodes, wherein a length of a portion of the resistor disposed on the pair of first upper-face electrodes taken along a first direction extending from one first upper-face electrode to the other first upper-face electrode is longer than a length of a portion of the resistor disposed between the pair of first upper-face electrodes taken along the first direction, and the pair of first upper-face electrodes are disposed between the insulating substrate and the resistor.

2. The chip resistor according to claim 1, wherein a distance between either of front ends of the both end portions of the resistor and either of end faces of the insulating substrate is set to 50 μm or more and 100 μm or less.

* * * * *